US006861582B2

(12) United States Patent
Street

(10) Patent No.: US 6,861,582 B2
(45) Date of Patent: Mar. 1, 2005

(54) SIGNAL CONTROLLER FOR A MUSICAL INSTRUMENT

(76) Inventor: Nicholas Crispin Street, 4 Brandon Close, Camberley, Surrey (GB), GU15 1BQ ( * ) Notice: Subject to any disclaimer, the term of this patent is extended or adjusted under 35 U.S.C. 154(b) by 0 days.

(21) Appl. No.: 10/306,661

(22) Filed: Nov. 29, 2002

(65) Prior Publication Data

US 2003/0101863 A1 Jun. 5, 2003

(30) Foreign Application Priority Data

Dec. 5, 2001 (GB) ..... 0129084
Nov. 8, 2002 (GB) ..... 0226173

(51) Int. Cl.[7] ..... G10H 7/00
(52) U.S. Cl. ..... 84/600; 84/723
(58) Field of Search ..... 84/600, 723, 730, 84/735, 737, 741

(56) References Cited

U.S. PATENT DOCUMENTS

| | | | | | |
|---|---|---|---|---|---|
| 4,563,933 | A | * | 1/1986 | Kim | 84/267 |
| 5,245,128 | A | * | 9/1993 | Araiza | 84/626 |
| 6,242,682 | B1 | * | 6/2001 | Marinic et al. | 84/626 |
| 6,640,257 | B1 | * | 10/2003 | MacFarlane | 710/1 |
| 2003/0000370 | A1 | * | 1/2003 | Kuroki | 84/737 |

FOREIGN PATENT DOCUMENTS

| | | |
|---|---|---|
| CA | 2335871 | 7/2001 |
| GB | 2375430 A | 11/2002 |
| SU | 1730669 A | 4/1992 |

* cited by examiner

*Primary Examiner*—Marlon Fletcher
(74) *Attorney, Agent, or Firm*—Pavel Pogodin, Esq.

(57) ABSTRACT

A signal controller for a musical instrument such as a guitar includes a liquid-filled tilt-sensor that has means to cause a variation in electrical resistance that is exploited by control circuitry to vary one or more qualities of the signal of the musical instrument. Such a signal may be a volume control, a tone control, a balance control and/or an effects control.

22 Claims, 5 Drawing Sheets

FIG. 8
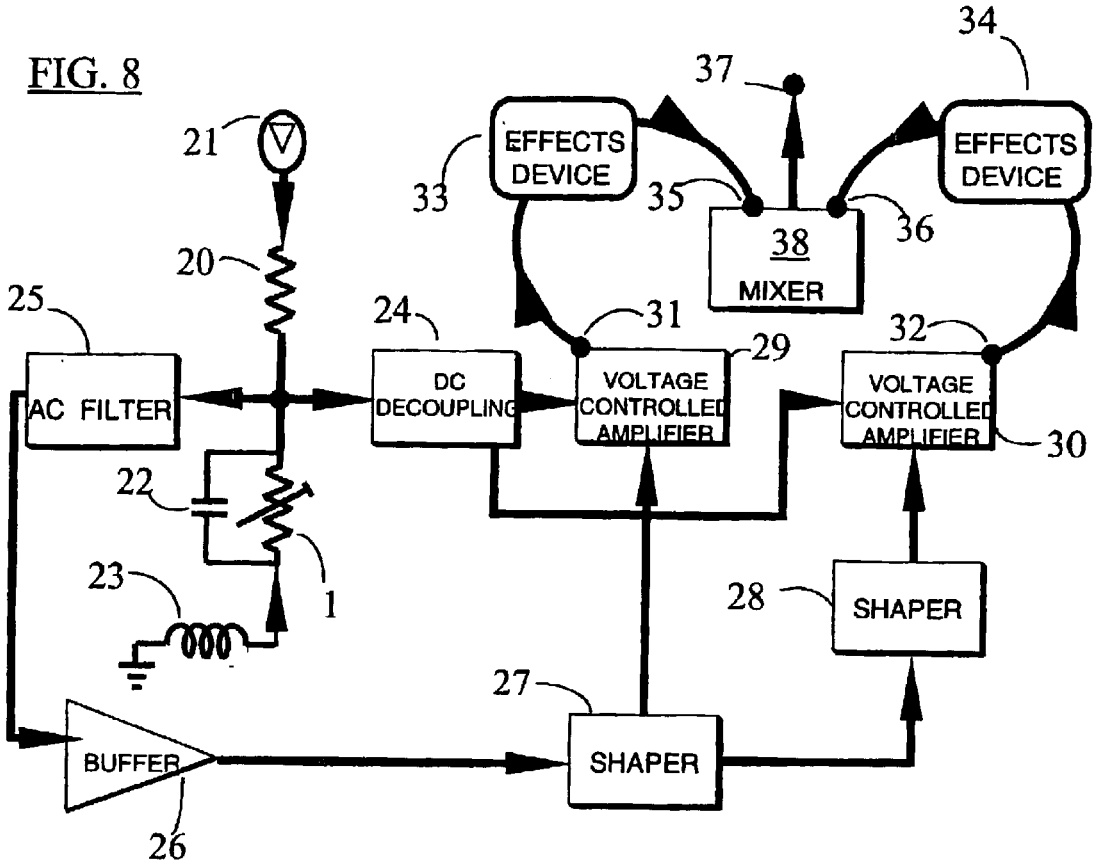
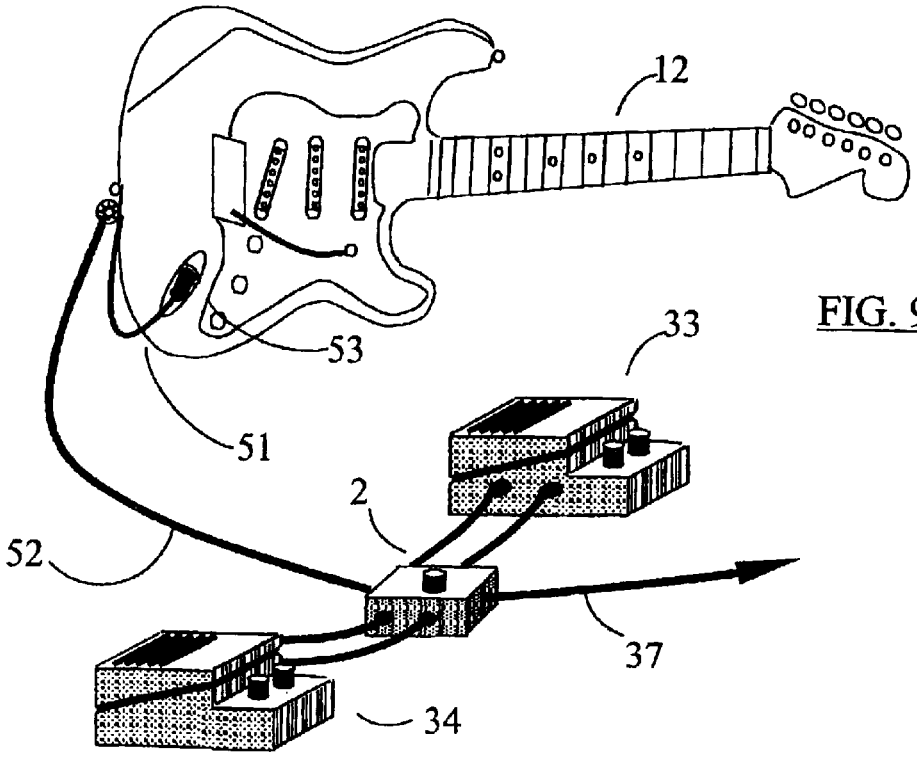
FIG. 9

SIGNAL CONTROLLER FOR A MUSICAL INSTRUMENT

FIELD OF THE INVENTION

This invention relates to the control of hand-held electrical or electronic musical instruments.

CROSS-REFERENCES TO RELATED APPLICATIONS

This regular U.S. patent application is based on and claims the benefit of United Kingdom provisional patent application Ser. No. 0129084.0, filed Dec. 5, 2001, and United Kingdom regular patent application Ser. No. 0226173.3, filed Nov. 8, 2002 the entire disclosures of which are relied upon and incorporated by reference herein.

DESCRIPTION OF THE RELATED ART

The signal generated by hand-held electrical or electronic musical instruments may be treated in a number of ways, it may have its volume and tone adjusted, and may be subjected to a range of effects such as: reverberation; echo; wah–wah and chorus.

Since most hand-held instruments need to be played with both hands, it is not easy for the player to adjust such signal treatment. Typically the player must either pause briefly to adjust a manual control such as a volume knob, or must use foot-pedals to adjust the signal treatment. Foot-pedals restrict the player's movement and may distract the player from the performance. In U.S. Pat. No. 4,078,467 Kawachi Kiyoshi describes a volume controller in which a pendulum acts as a tilt-sensor and affects the value of a variable circuit element. That invention allowed a musician to control the volume of a musical instrument by tilting it to a particular degree.

One of the features of the inventive concept is a simple technique by which the sound qualities of a hand-held musical instrument's signal can be altered through variation of the angle at which the instrument is held. Tilting of an instrument requires little conscious effort on the part of the player and is a simple and instinctive way to achieve changes in sound quality.

The spirit-level is a familiar example of a device that indicates tilt. This principle has given rise to a number of liquid filled tilt-sensors which exhibit a variation of electrical resistance according to the degree by which the sensor is tilted. The liquid filled tilt-sensor referred to herein may be any one of several types, the liquid being typically either an electrolyte or mercury.

SUMMARY OF THE INVENTION

According to one aspect of the present invention there is provided a signal controller comprising a liquid activated tilt-sensor which causes a variation of electrical resistance and circuitry to exploit said variation in such a way as to alter the treatment of a signal of a musical instrument.

According to a second aspect of the present invention there is provided a musical instrument including a signal controller to control tone of the musical instrument by using a tilt-sensor which causes a variation of electrical resistance and circuitry to exploit the variation in such a way as to alter the tone.

According to a third aspect of the present invention there is provided a musical instrument including a signal controller to control balance of the musical instrument by using a tilt-sensor which causes a variation of electrical resistance and circuitry to exploit the variation in such a way as to alter the balance.

According to a fourth aspect of the present invention there is provided a musical instrument including a signal controller to control effects of the musical instrument by using a tilt-sensor which causes a variation of electrical resistance and circuitry to exploit the variation in such a way as to alter the effects.

Suitable means can be provided to mount components of the signal controller. Means can be provided to adjust the signal controller.

The invention allows a wide range of signal treatments to be controlled, including, but not limited to: volume control; equalisation; balance between multiple signal sources; balance between multiple signal destinations; and the control of electronic effects circuitry.

BRIEF DESCRIPTION OF THE DRAWINGS

For a better understanding of the invention and to show how the same may be carried into effect, reference will now be made, by way of example, to the accompanying drawings, in which:

FIG. 8 is a schematic diagram of a fourth embodiment of the invention, namely an effects controller;

FIG. 9 is a perspective diagram showing the interconnection of components in FIG. 8;

DETAILED DESCRIPTION

In the following detailed description, reference will be made to the accompanying drawings, in which identical functional elements are designated with like numerals. The aforementioned accompanying drawings show by way of illustration, and not by way of limitation, specific implementations consistent with principles of the present invention. These implementations are described in sufficient detail to enable those skilled in the art to practice the invention and it is to be understood that other implementations may be utilized and that structural changes may be made without departing from the scope and spirit of present invention. The following detailed description is, therefore, not to be construed in a limited sense.

Figure 1:
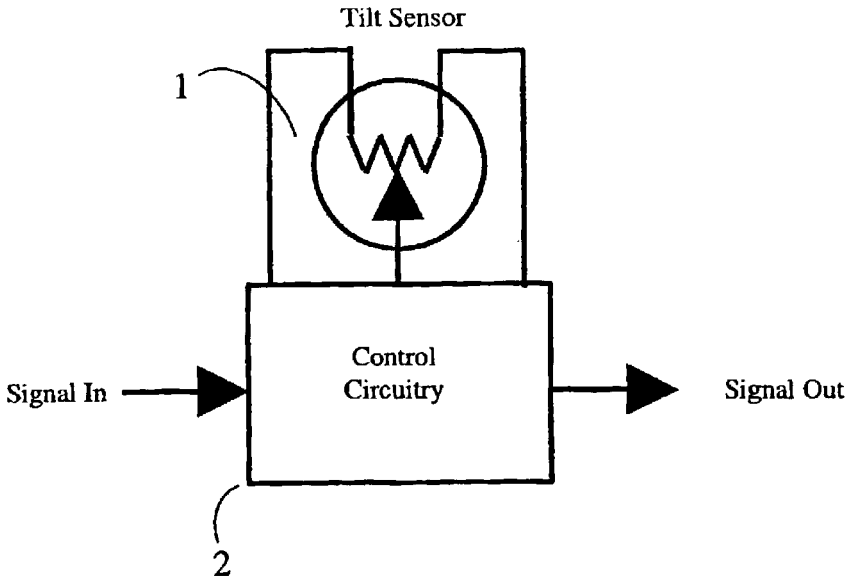
FIG. 1 is a block diagram showing functional components of a signal controller for a musical instrument.

The signal qualities of a portable musical instrument may be controlled by the tilt of the instrument by incorporating the present invention in the instrument's signal path. This is shown as a functional diagram in FIG. 1. The liquid filled tilt-sensor 1 causes a variation in electrical resistance that is exploited by the control circuitry to vary one or more qualities of the instrument's signal.

Figure 2:
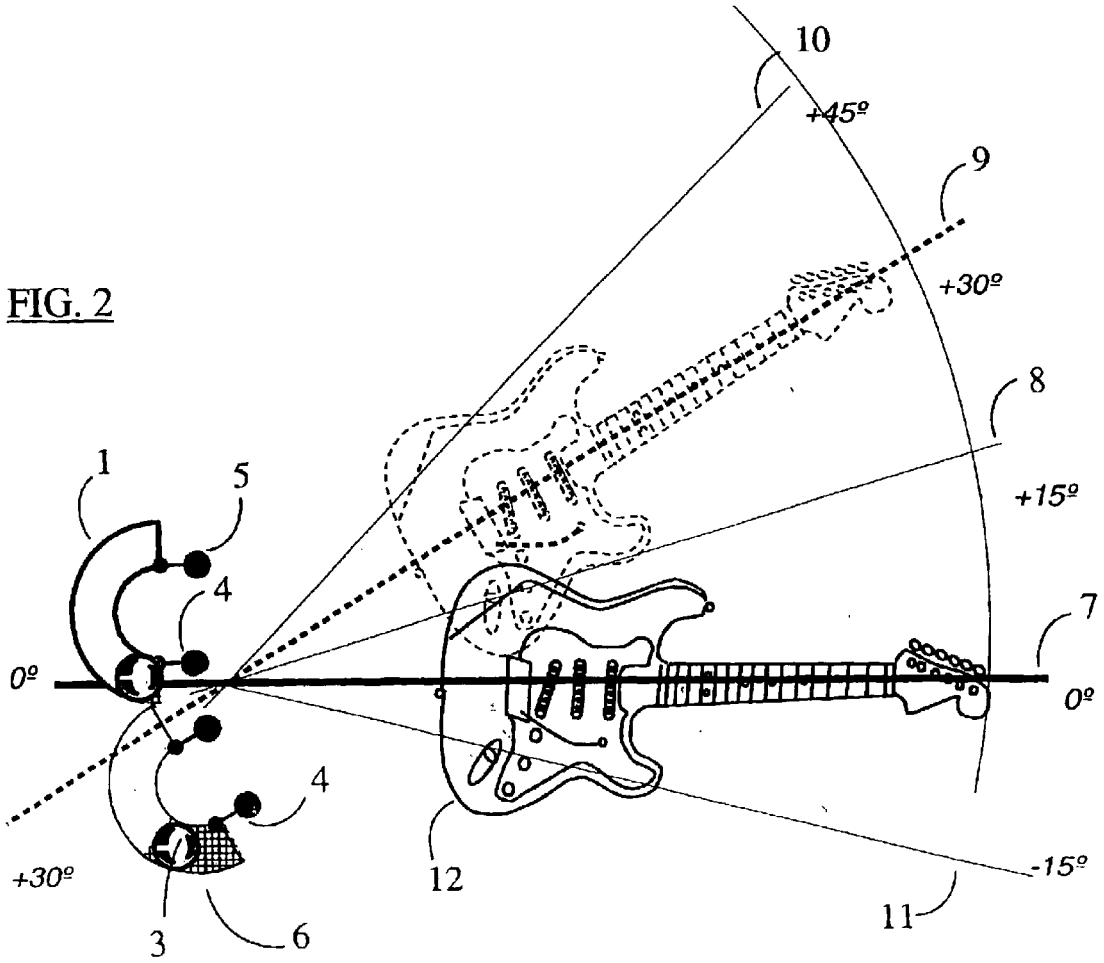
FIG. 2 shows the way in which a portable instrument, such as an electric guitar, may be tilted by the player, and the corresponding effect on a conceptual liquid-filled tilt-sensor.

FIG. 2 illustrates the tilting of a hand-held instrument through an angle, and the effect this has on a potentiometric tilt-sensor mounted on the instrument. To aid in the understanding of circuit design issues, an example tilt-sensor is shown consisting of a mercury bead 3 which may be thought of as the potentiometer's wiper, whose distance from the respective terminals 4 and 5 on a resistive carbon track determines the resistance between wiper and terminal.

It will be seen that as the angle changes, the position of the mercury remains static, and the proportion of carbon-track 6 between mercury wiper 3, and terminal 4 changes. This changing resistance value is exploited by the embodiments of the invention which are considered in the following paragraphs. Other types of liquid-filled tilt-sensors may be similarly employed.

Figure 3:
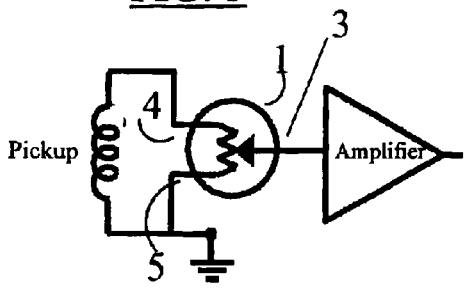
FIG. 3 is a schematic circuit diagram of one embodiment of the invention, namely a volume controller.

The controller may be used to vary the volume of a musical instrument such as an electric guitar. The controller is inserted in the signal path between the signal source, typically the guitar's pickups, and the signal destination, typically an amplifier. This is illustrated schematically in FIG. 3. As the guitar's tilt is varied so the resultant volume changes. The tilt-sensor acts as a potential-divider having a common terminal 5, an input terminal 4 and a wiper terminal 3.

Figure 4:
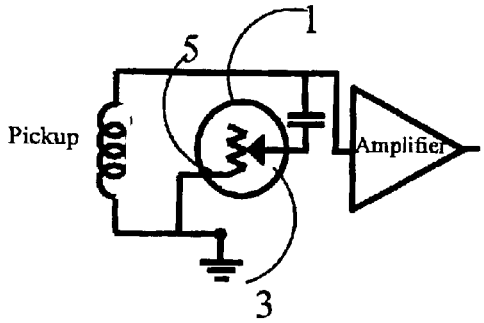
FIG. 4 is a schematic circuit diagram of a second embodiment of the invention, namely a tone control.

Similarly the controller may be used to provide a tone control as illustrated in FIG. 4. As the instrument's tilt is varied, so the treble component of the signal varies.

Figure 5:
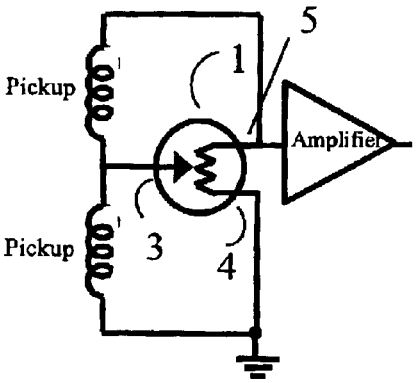
FIG. 5 is a schematic diagram of a third embodiment of the invention, namely a pickup balance control.

The controller may be used to alter the balance between signal sources. One application would be to allow a guitar player to select which of two pickups is dominant when changing from accompaniment to solo playing. This is illustrated in FIG. 5.

In FIG. 8 and FIG. 9 the controller is used to vary the respective levels of a series of effects devices. This embodiment will now be considered in detail.

In FIG. 9 the musical instrument 12 is shown connected to the effects controller 2 through audio-cable 52. The controller is connected to amplification or recording equipment through cable 37. All the interconnecting cables shown in FIG. 9 are conventional, monophonic audio cables.

The effects pedals 33 and 34 are governed by the tilt-sensor 1. At one extreme of the tilt-sensor's range effects pedal 33 is not attenuated, and effects pedal 34 is heavily attenuated. Conversely at the opposite extreme of the tilt-sensor range, effects pedal 34 is not attenuated, and effects pedal 33 is. In this way the treatment of the signal may be varied to any desired combination of two effects. For instance, a musician might choose to apply reverberation at the beginning of a performance, later changing to a chorus effect, finally combining chorus and reverberation at the end of the performance by tilting the instrument to the intermediate angle 8 in FIG. 2.

The way in which this variation is controlled is shown in FIG. 8. The first stage of the circuit exploits the fact that the instrument cable 52 can be used to carry both the normal audio signal, and a controlling DC signal, so long as these two are separated by later stages. The DC control signal 21 is injected into the instrument cable 52. The resistor 20 and tilt-sensor 1 form a potential-divider, so that variation of 1 causes a variation of DC voltage at their junction. The instrument pickup 23 serves to complete this potential-divider circuit, presenting as it does a relatively small DC resistance.

From an AC perspective the signal generated by the instrument's pickup or pickups is largely unaffected by variable-resistor 1, since bypass-capacitor 22 provides a low-impedance path to audio frequencies.

The two signal components are segregated by AC-filter 25 and DC de-coupler 24 such that only the audio signal is passed to the signal inputs of the VCAs 29 and 30, and only the DC voltage is passed to the buffer 26.

The left-hand connection to each the VCAs 29 and 30 is for the input signal, the lower connection is for the controlling voltage, and the upper connection is for the output. It will be seen that the shapers 27 and 28 are connected to the control terminals of the VCAs 29 and 30 respectively.

The operation of this embodiment can be appreciated by first imagining the shaper circuits 27 and 28 to be inverting amplifiers. By adjusting the tilt-sensor 1 to a high resistance value a high voltage would be produced by shaper 27 and a low voltage by shaper 28. Conversely by reducing the value of 1, a low voltage would be produced by shaper 27 and a high voltage by 28. Thus by adjusting the value of resistance, the respective output levels of the two VCAs can be varied in any combination.

The VCA outputs feed the effects circuits 33 and 34. The output levels of the effects circuits reflect the level of signal from their respective VCA. Thus when the signals are combined by the mixer 38, the dominance of one effect or the other will be determined by the setting of the tilt-sensor.

A number of other embodiments of the invention will be apparent using this technique. One being to mix treated and untreated signals, another would involve feeding two separate audio channels from the outputs of the two VCAs allowing stereo panning between two channels. A further embodiment would replace the effects devices with filters to allow the tone of the instrument to be controlled. Yet another embodiment would be to connect an effects device such as a fuzz box or overdrive between the decoupler 24 and one VCA 29 or 30 to allow the volume of a saturated signal to be adjusted.

Figure 6:
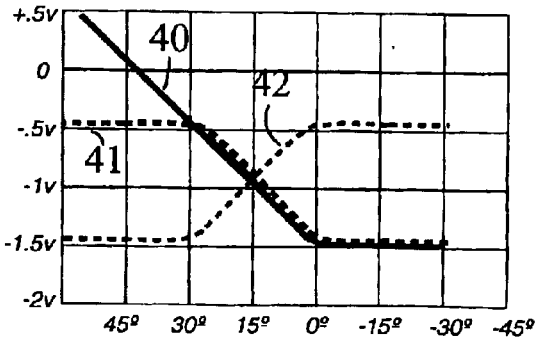
FIG. 6 is a graph showing the required voltage shaping for two complementary VCAs used in an effects controller.

To achieve satisfactory operation, several design issues need to be addressed which now be considered, each of the components in FIG. 6 will become apparent in the description.

The first design consideration relates to symmetry of output from the two VCAs 29 and 30. FIG. 2 shows a guitar whose playing angle is varied between the angles 7 and 9. At angle 9 the VCA 29 should be fully on, providing unity gain, and VCA 30 fully off providing no gain. At angle 7 VCA 29 should be off and 30 should be fully on.

To achieve symmetry, the VCAs must be fed complementary control voltages as indicated by 41 and 42 in FIG. 6. This demands that the more negative the control voltage, the higher the gain of the VCA, but that any control voltage more positive than −0.5 volts will result in zero gain. A control voltage of −1.5 volts will provide unity gain. It is not desirable to increase the gain of either VCA beyond unity, since a complementary response is desired in order to pan uniformly from one VCA to the other.

In the example in FIG. 2, 30 degrees of range represents only ⅙ of the range of the sensor. The lower boundary of operation is enforced by the limit on the movement of the mercury 3. However, increasing the angle from 9 to 10 will increase the distance indicated by 6 and thus increase the resistance. It is necessary to prevent this further change in resistance from affecting the output of the VCAs. This limiting is achieved by the shaper 27.

Consider again the output from shaper 27 if it were simply an inverting amplifier. An increase in elevation of the sensor would lead to an increase in its resistance, this in turn increasing the voltage input to the buffer 26. Both the buffer 26 and shaper 27 invert their inputs, thus the output from the shaper increases with elevation as indicated by 40 in FIG. 6. The required response however, is indicated by 41, such that an increase in elevation beyond 30 degrees does not result in any further increase in voltage. Once this is assured, the second shaper 28 can simply subtract the output of shaper 27 from a constant value to achieve the complementary response 42.

Figure 10:
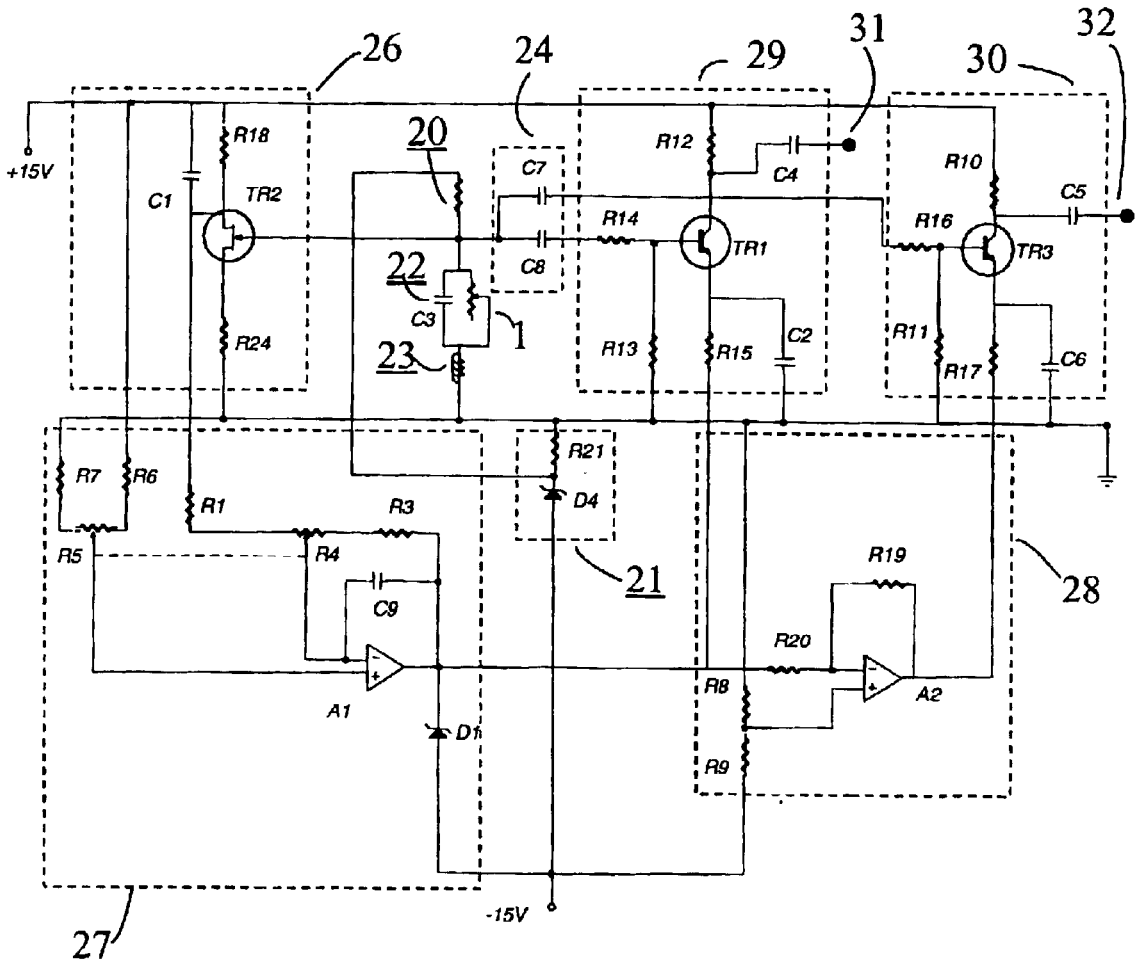
FIG. 10 is a schematic circuit diagram showing the individual components used in one example of an effects controller.

Referring to FIG. 10, the desired response is achieved by the inclusion of the Zener diode Db. The diode has no effect on the output voltage of the amplifier A1 until the Zener voltage is reached, this being −0.5 volts relative to ground. Any output voltage more positive than that is clamped down to −0.5 volts by the diode.

The shaper 28 in FIG. 10 uses A2 to subtract the output voltage of 27 from the constant value −2 volts giving the complementary response 42 in FIG. 6. The Resistors R8 and R9 in FIG. 10 provide the required −2 volts, the resistors R19 and R20 providing a 1:1 feedback ratio for unity gain.

The second design issue relates to the sensitivity of the circuit to variation of tilt-sensor 1. One individual may wish the operating range to be achieved with a 30 degree span, while another may prefer a 45 degree span.

Figure 7:
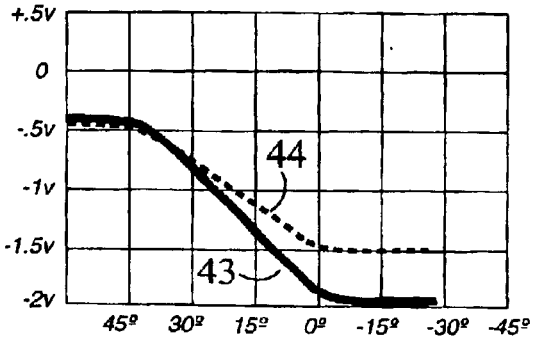
FIG. 7 is a graph showing the voltage shaping required to alter the sensitivity of an effects controller circuit.

A desirable feature of the controller, therefore, is a fully variable sensitivity control. The sensitivity indicated by 41 in FIG. 6 can be decreased to that indicated by 43 in FIG. 7 by setting the non-inverting input of A1 in FIG. 10 to be more negative, since a wider range of input voltage is then required before the clamping threshold of D1 is reached. The resistor network R5, R6 and R7 is used to vary the voltage applied to A1.

It will be seen that the sensitivity has thus been decreased by 15 degrees. An undesirable side effect of this is that the maximum output, has been increased by 0.5 volts. This would increase VCA gain, and require the musician to make a compensatory change in volume settings whenever sensitivity was adjusted.

The resistor network R3, R4 and R1 are used to automatically compensate for the increase in output. R4 and R5 represent a dual-gang potentiometer causing gain to be reduced proportionally as amplifier sensitivity is reduced. It will be seen that the maximum gain possible is (R4+R3)/R1 and the minimum gain possible is R3/(R4+R1), the resistor configuration shown provides a very uniform relationship of gain in response to variation of R5.

The third design issue concerns possible phase inversion by the effects devices 33 or 34. The mixer 38 is used to re-combine the signal after treatment by these effects, providing a single output signal. It is quite possible that an effects device could invert the phase of the signal. This would cause the mixer to act as a differential amplifier, which is unlikely to be desirable. Accordingly a suitable audio mixer with inverting, as well as a non-inverting inputs is required.

The purpose of those components in FIG. 10 not previously described is as follows: The capacitors C1 and C9 constitute the AC filter indicated by 25 in FIG. 8. R18, TR2 and R24 constitute the buffer 26 in FIG. 6, this being a conventional common-source JFET circuit.

29 is a VCA. It is a common emitter circuit using an NPN bipolar transistor. R13 provides a base bias voltage, and the combination of R14 and R13 attenuate the input signal. Instead of the emitter resistor R15 being tied to ground, it governs the emitter current in response to the control voltage being applied to it, such that the more negative the control voltage, the greater the VCA gain. Bypass-capacitor C2 maximises AC amplification, and C4 de-couples the DC from the output path 31. The constituent parts of VCA 30 function in the same way as 29.

D4 and R21 provide the small DC voltage source 21. C7 and C8 constitute the DC de-coupler 24. The value of capacitor 22 should be high enough to present little impedance to the audio frequency signal generated by the pickup 23. However this must be weighed against a low time-constant of capacitor 22 and resistor 20, since high-values would result in slow responsiveness to variation of the tilt-sensor 1.

Example component values are shown in the table below.

| | | | | | |
|---|---|---|---|---|---|
| R1 | 151K | 1.1.1R9, R10, R12 | 10K | 1.1.2C4, C5 | 1 uF |
| R2 | 1.6M | R11, R13 | 20K | TR2 | 2N5457 |
| R3 | 977K | R14, R16 | 510K | TR1, TR3 | BC457B |
| R24 | 560 | R15, R17, R18 | 5600 | D4 | 13 V |
| R6 | 549K | R20 | 5.1M | D1 | 14.5 V |
| R7 | 729K | R9, R10, R12, R19 | 10K | A1, A2 | UA741 |
| R8 | 82K | C3, C7, C8, C9 | .1 uF | R4/R5 | 100K LIN |
| R21 | 2200 | C1 | 4.7 uF | | |

The inclination of the tilt-sensor should be adjustable. This allows individual musicians to choose the playing angle representing the low end of operation of the sensor. The angle will generally be within a few degrees of the horizontal plane, indicated by 7 in FIG. 2.

Figure 11:
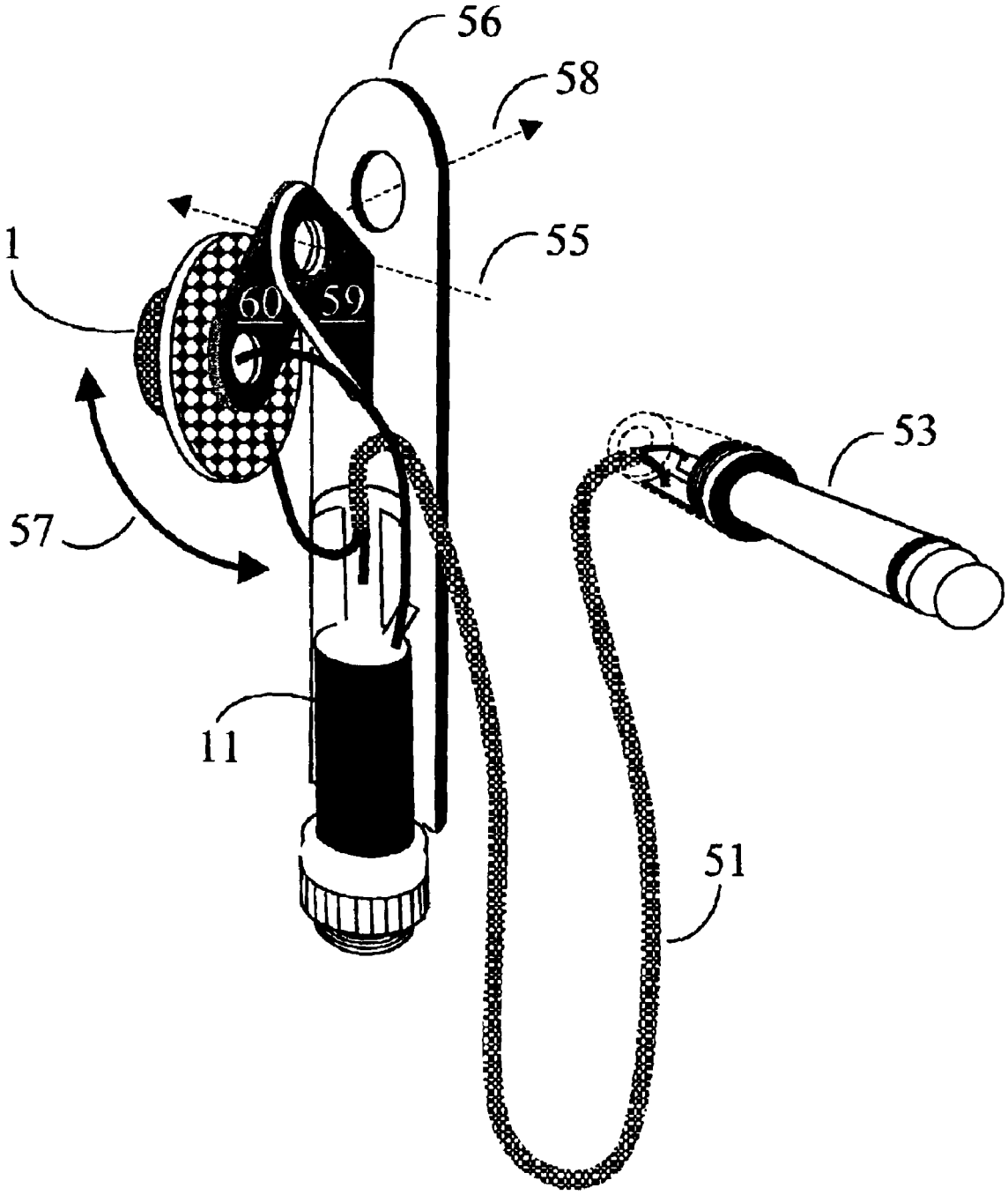
FIG. 11 is a perspective view of a means of mounting the tilt-sensor.

A suitable means for mounting the tilt-sensor is illustrated in FIG. 11, an electric-guitar being used as an example. Capacitor 22 and shielding are omitted for clarity.

The ¼ inch jack-socket 11 receives the instrument cable. The ¼ inch jack-plug 53 is connected to the guitar's pickup socket. The guitar's strap-pin is passed through the hole in mounting-pate 56, as shown by arrow 58. The mounting-plate is thus secured between the butt of the guitar and the strap-pin's screw-head.

An arm 59 is attached to the mounting-plate. The tilt-sensor 1 is attached to a 'forearm' 60. The arm and 'forearm' are connected using a bolt passed through holes in each, following arrow 55. Tightening a nut on this bolt, the forearm may be secured in any position desired on the path indicated by arrow 57. Several similar means of mounting the tilt-sensor, and allowing adjustment of its orientation will be apparent.

It should be noted that the use of DC as a control signal, as shown in FIG. 8 represents only one variation of this embodiment. Ultrasonic AC might be a feasible alternative, if, for instance, an electrolytic tilt-sensor were employed.

In summary the present invention provides a simple means by which the sound qualities of a portable musical instrument's signal can be altered by varying the angle at which the instrument is held. This offers several advantages to a player. For example, by using the controller shown in FIG. 3, a musician could enhance a performance by appropriate variations in volume. By using the controller shown in FIG. 8, the musician could vary the respective levels of various effects devices during the performance, or perform stereo panning across a stage.

It will be appreciated that the pendulum operated volume controller of U.S. Pat. No. 4,078,467 suffered from two disadvantages that the present invention is intended to address. Firstly, the present invention allows more than just volume to be controlled: any quality of the instrument's signal that can be affected by a variable-resistor may likewise be controlled by the present invention. Secondly pendulum controlled tilt-sensors, having moving parts, are relatively costly to manufacture, and potentially prone to failure and accordingly a liquid filled tilt-sensor is employed in the present invention.

It should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein.

The present invention has been described in relation to particular examples, which are intended in all respects to be illustrative rather than restrictive. Those skilled in the art will appreciate that many different combinations of mechanical and electronic components including, without limitation, hardware, software, and firmware will be suitable for practicing the present invention.

Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A signal controller comprising:

(a) an input for receiving a signal from a musical instrument;

(b) a liquid activated tilt-sensor which causes a variation of an electrical resistance, wherein the electrical resistance of the tilt-sensor varies in a predetermined continuous range of resistance values in accordance with an angle of inclination of the tilt sensor;

(c) a circuitry to detect said variation and exploit said variation to control the treatment of the received signal of said musical instrument; and (d) an output for outputting the treated signal of the musical instrument.

2. The signal controller of claim 1, further comprising a volume control device for controlling the volume characteristics of the signal of the musical instrument.

3. The signal controller of claim 1, further comprising an equalization control device for controlling equalisation of signals of the musical instrument.

4. The signal controller of claim 1, further comprising a balance control device for controlling the relative levels of signals applied to at least two signal paths.

5. The signal controller of claim 1, further comprising a circuitry for controlling an electronic effects device of the musical instrument; wherein said circuitry controls said electronic effects device by varying a level of an audio signal applied to said electronic effects device.

6. The signal controller of claim 1, further comprising a signal controller adjusting device comprising a friction hinge for adjusting the signal controller.

7. The signal controller of claim 1, wherein the tilt-sensor is a potentiometric tilt-sensor.

8. The signal controller of claim 7, wherein the tilt-sensor comprises a bead of mercury running on a resistive carbon track.

9. The signal controller of claim 1, wherein said circuitry detects said variation through said musical instrument's signal cable.

10. A musical instrument comprising a signal controller, said signal controller comprising:

(a) an input for receiving a signal from the musical instrument;

(b) a liquid activated tilt-sensor which causes a variation of an electrical resistance, wherein the electrical resistance of the tilt-sensor varies in a predetermined continuous range of resistance values in accordance with an angle of inclination of the tilt sensor;

(c) a circuitry to detect said variation and exploit said variation to control the treatment of the received signal of said musical instrument; and (d) an output for outputting the treated signal of the musical instrument.

11. The musical instrument of claim 10, wherein the signal controller further comprises a volume control device for controlling the volume characteristics of said signal of said musical instrument.

12. The musical instrument of claim 10, wherein the signal controller further comprises an equalization control device for controlling equalisation of signals of the musical instrument.

13. The musical instrument of claim 10, wherein the signal controller further comprises a balance control device for controlling the relative levels of signals applied to at least two signal paths.

14. The musical instrument of claim 10, wherein the signal controller further comprises a circuitry for controlling an electronic effects device of the musical instrument; wherein said circuitry controls said electronic effects device by varying a level of an audio signal applied to said electronic effects device.

15. The musical instrument of claim 10, wherein the signal controller further comprises a signal controller adjusting device comprising a friction hinge for adjusting the signal controller.

16. The musical instrument of claim 10, wherein the tilt-sensor is inclined with respect to the musical instrument and wherein said musical instrument further comprises a friction hinge for adjusting the inclination of the tilt-sensor with respect to said musical instrument.

17. The musical instrument of claim 10, wherein said musical instrument is an electric guitar.

18. The musical instrument of claim 10, wherein said treatment comprises adjusting of a tone of said signal.

19. The musical instrument of claim 10, wherein said treatment comprises adjusting the relative levels of signals applied to at least two signal paths.

20. The musical instrument of claim 10, wherein said treatment comprises adjusting of effects of said signal.

21. The musical instrument of claim 10, wherein said circuitry detects said variation through said musical instrument's signal cable.

22. A method for controlling treatment of a signal of a musical instrument, said method comprising:

(a) receiving a signal from the musical instrument (b) detecting a variation of an electrical resistance of a liquid activated tilt-sensor, wherein the electrical resistance of the tilt-sensor varies in a predetermined continuous range of resistance values in accordance with an angle of inclination of the tilt sensor;

(c) determining a tilt of said musical instrument based on said detected variation; and (d) using said determined tilt to control the treatment of the signal of said musical instrument;

(e) outputting the treated signal of the musical instrument.

* * * * *